United States Patent [19]

Kenyon

[11] 4,363,202

[45] Dec. 14, 1982

[54] APPARATUS FOR LINING KILNS, TUNNELS AND THE LIKE

[76] Inventor: Eugene B. Kenyon, Rte. 1, Box 34, Star Tannery, Va. 22654

[21] Appl. No.: 159,635

[22] Filed: Jun. 16, 1980

[51] Int. Cl.[3] ..... E04G 21/22

[52] U.S. Cl. ..... 52/749; 405/146; 414/10

[58] Field of Search ..... 254/93 HP; 414/10, 11; 52/749; 405/146, 151

[56] References Cited

U.S. PATENT DOCUMENTS 3,298,155 1/1967 Byfield ..... 405/146
3,371,459 3/1968 Thomas ..... 52/749
3,550,344 12/1970 Maier ..... 405/146
3,707,060 12/1972 Jansen ..... 52/749
3,863,420 2/1975 Peiffer ..... 52/749

*Primary Examiner*—Trygve M. Blix
*Assistant Examiner*—D. W. Keen
*Attorney, Agent, or Firm*—Le Blanc, Nolan, Shur & Nies

[57] ABSTRACT

A rig for lining with brick a kiln, tunnel or like surface embodies a frame that is of variable size to suit different surface diameters, and two relatively adjustable jacks support deformable arcuate brick column support members at each opposite sides of the frame. Each arcuate member is a continuous longitudinally deformable trough containing an expansible tube overlaid by a solid rubber or like flexible brick contact element.

12 Claims, 11 Drawing Figures

APPARATUS FOR LINING KILNS, TUNNELS AND THE LIKE

This invention relates to apparatus for lining the internal curved surfaces of kilns, tunnels and the like with bricks.

The bricks are arranged in circumferential rows, starting with a row at one end of the surface and advancing row by row to the other end of the surface. Normally at each row the lower semicircular column of bricks is installed manually in a conventional manner. However, particularly for large diameter surfaces, problems are encountered in installing the upper semicircular column in each row, as the bricks are relatively heavy and bulky and must be held against gravity.

The invention will be described in its preferred embodiment as apparatus adapted for lining a relatively large diameter kiln with bricks, and it embodies a special rig arrangement whereby opposite columns of a brick placed on arcuate members are simultaneously controllably advanced under pressure toward the upper half of the surface to be lined.

It has been proposed as in the patent to Byfield, U.S. Pat. No. 3,298,155 dated Jan. 17, 1967 to arrange opposite columns of brick on rigid arcuate members that are advanced toward the kiln surface to be lined. The present invention represents improvements in structure and mode of operation with respect to the Byfield type apparatus.

It is a major object of the invention to provide a novel apparatus for lining a kiln or the like with brick wherein at least one column of brick is placed on an arcuate member that is longitudinally deformable so that it may be adjusted to suit the contour of the surface to be lined, and the conformed arcuate member with its column of bricks is movable toward the surface to be lined. Pursuant to this object the arcuate member is of novel construction, namely a continuous flexible metal base strip having bonded on opposite sides upstanding rubber or like flexible bands that define a longitudinally deformable trough with the base and do not resist bending of the base as the member is deformed.

Another object of the invention is to provide a rig for lining a kiln with brick wherein a relatively rigid rig frame has at least two adjustable jacks at each side mounting longitudinally bendable arcuate brick locating and supporting members.

A further object of the invention is to provide a novel structure for an arcuate brick support member, wherein an outwardly open trough consisting of a longitudinally bendable base with flexible stretchable side walls encloses coextensively a tubular expansible member overlaid by a flexible relatively solid brick contacting element, whereby a column of bricks laid in place on that element may be advanced onto the surface to be lined when the tubular member is expanded. In embodiments of this structure under pressure, a flexible strip of metal overlies the solid member to serve as the brick contacting surface, and that strip may bear pads to compensate for irregularities of the brick.

A further object of the invention is to provide apparatus for lining a kiln or the like wherein opposite arcuate brick support members are mounted on a rig frame that is laterally adjustable to suit different kiln diameters.

Further objects of invention will appear in connection with the following disclosure and claims and as shown in the accompanying drawings.

PREFERRED EMBODIMENTS

Figure 1:
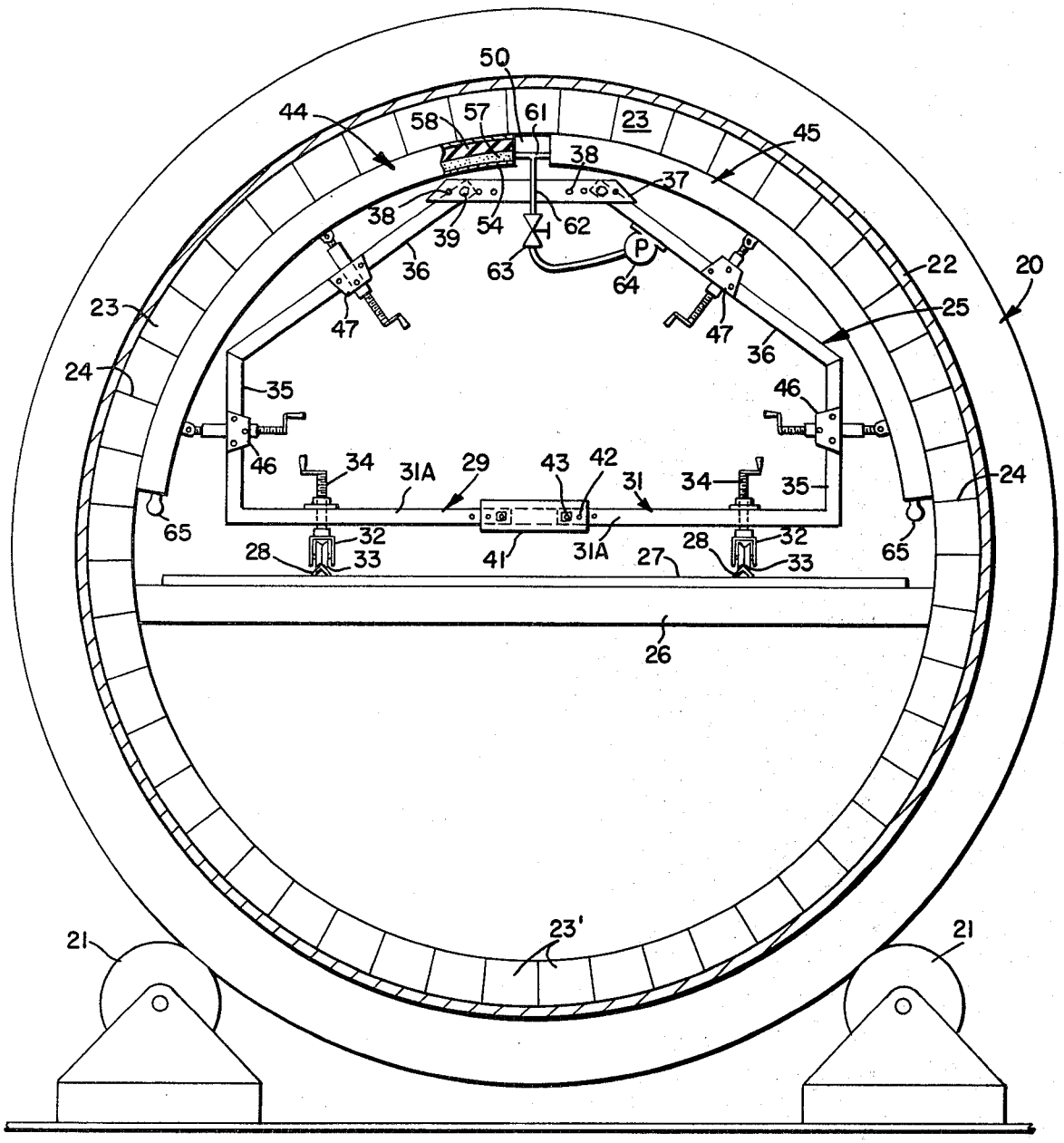
FIG. 1 is an end view partly in cross section of a rotary kiln illustrating apparatus and mode of operation for lining the same according to a preferred embodiment of the invention.

Referring to FIG. 1 a cylindrical kiln generally designated at 20 is mounted with its longitudinal axis horizontal, and rotatably supported on parallel rollers 21 whereby if desired it may be turned about that axis. Normally however, during the kiln lining operation to be described, the kiln is maintained against such rotation.

These kilns are normally about eight to fourteen feet in internal diameter, or even larger.

Kiln 20 has a continuous cylindrical inner shell 22, usually metal, and the bricks 23 to line the kiln are all adapted to contact the inner surface of that shell. With the kiln stationary the lower half of each lining column or row is installed by workmen starting at the bottom as at bricks 23' and building the lining brick by brick up the opposite sides for over 180° until about the level indicated at 24 on both sides. This is conventional.

The invention is essentially concerned with apparatus used in lining the upper half of the shell. At this point a rig generally indicated at 25 is mounted within the kiln. A support frame 26 which may be of wood extends across the kiln and carries a flat work platform 27 for the workman that lies in a horizontal plane along approximately the diameter of the kiln. Platform 27 is the sole support of rig 25. Frame 26 is fixed relative to the kiln. In operation the platform 27 is usually about sixteen feet long, and it is advanced along the kiln as the rig is advanced.

Disposed on platform 27 are parallel tracks 28 that are advanced along with the platform. A rig frame 29 comprises a transverse horizontal lower member 31 that may be parallel to platform 27. Disposed below member 31 are truck frames 32 each mounting truck wheels 33 adapted to roll along tracks 28. Adjustable truck jacks 34 connect each truck frame 32 to the member 31. The entire rig frame 29 may be moved longitudinally within the shell in increments as each circumferential row of bricks is laid. Adjustment of jacks 34 may change the level of the rig frame relative to the kiln, or change the attitude to suit conditions.

The rig frame also comprises vertical frame members 35 upstanding from the ends of member 31, and upper frame members 36 inclined upwardly and inwardly of the kiln from the upper ends of members 35. The ends of members 36 are secured to a common top frame member 37. Top frame member 37 has a series of optionally usable bolt holes 38 through which pass bolts 39 into matching holes in members 36. Similarly lower frame member 31 may be composed of two opposite elements 31A held together by a telescoped bridging member 41 having a series of bolt holes 42 through which pass bolts 43 into matching holes of elements 31A. It is thus possible by selection of the matching bolt holes to readily adjust the effective width of the rig frame 29, and the purpose of this will be later described. When members 37 and 41 are bolted in place the frame 29 is an effectively rigid structure.

A pair of generally cylindrical arcuate brick support members 44 and 45, adapted to support and locate the bricks to be applied to the upper half of the shell are mounted on frame 29, and they extend in spaced relation to the shell. Each arcuate member is about 90° in extent, and each is carried by at least two relatively adjustable jacks, as at 46 and 47.

As shown in FIG. 1 adjustable jacks 46 and 47 are mounted on the frame members 35 and 36 respectively at each side. By relative adjustment of these jacks the arcuate members 44 and 45 may be conformably curved and accurately positioned relatively to the shell.

Figure 3:
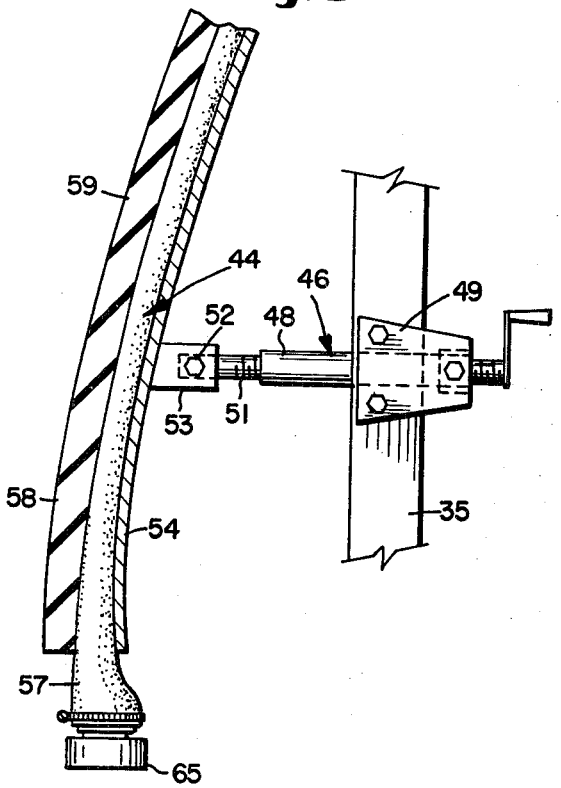
FIG. 3 is a fragmentary view partly in section showing the expansible system and a related adjustable support jack.

FIG. 3 illustrates the mounting of each jack 46 and 47 on the frame. The barrel 48 of the jack is mounted by a reversible flange 49 that may be bolted to frame member 35, and the extendible jack rod 51 is pivotally connected at 52 to a lug 53 fixed on arcuate member 44.

Each of the arcuate members 44 and 45 comprises a continuous base strip (FIG. 3) of metal 54, preferably steel, that is flexible enough to be deformed longitudinally by jack adjustment but strong enough to maintain an imparted shape and location even when loaded with bricks and when pressure is applied to contact the bricks with the shell.

Figure 4:
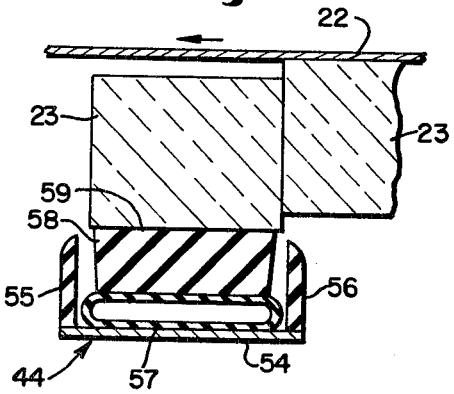
FIGS. 4 and 5 are fragmentary cross sectional views showing the relaxed and expanded operative conditions of the brick support members.
Figure 5:
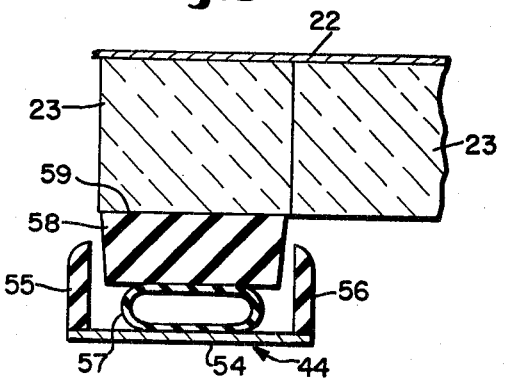

Along the opposite side edges of each member 44 and 45 extend continuous rubber or like flexible retainer bands 55 and 56 as shown in FIGS. 4 and 5, whereby in cross section each composite arcuate member 44 and 45 appears as an outwardly open continuous trough. These bands 55 and 56 are continuous from end to end of the strip 54, and they are securely bonded to the metal strip 54 as by vulcanization.

Disposed in and extending the length of the trough of each arcuate member 44 and 45 is an elongated tubular expansible pressure applying element 57 lying along the bottom of the trough, and a sturdy relatively solid flexible brick contacting element 58 directly overlying the element 57 with opposite side edges disposed closely adjacent bands 55 and 56. Preferably element 58 is a uniform width length of reinforced wear resistant rubber strap or belting, and its outer convex surface 59 which in a preferred embodiment is the direct brick contacting surface is flat from side to side, as in FIGS. 4 and 5. When the expansible element 57 is relaxed with little or no internal air pressure, the element 58 lies substantially within the trough with its surface 59 about level with the tops of side bands 55 and 56, and a column of bricks placed thereon will be substantially radially spaced from the shell as shown in FIG. 4. When element 57 is expanded, as by increased air pressure as will appear, the element 58 is bodily displaced outwardly toward the kiln shell to urge the row of bricks thereon against the shell as shown in FIG. 5. In operation the trough serves to retain the expansible element 57 and the solid element 58 in relation, and the sides of the trough guide the solid member in its radial movement when member 57 is inflated. The trough sides also serve as safety guards in the event expansible member 57 ruptures.

Figure 1A:
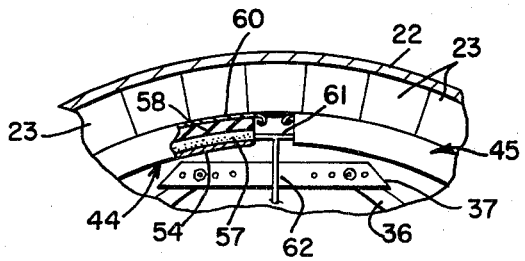
FIG. 1A is a fragmentary view mainly in section showing detail of pressure connections to the arcuate brick support members.
Figure 2:
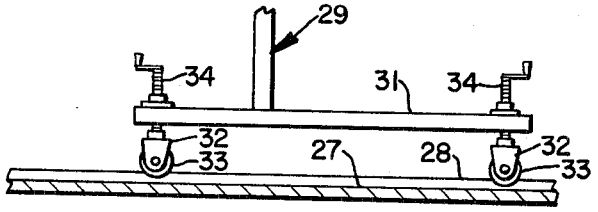
FIG. 2 is a fragmentary view partly in section showing movable mounting of the rig frame on platform tracks.
Figure 3A:
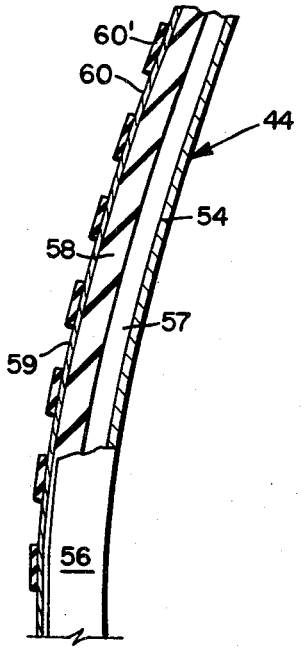
FIG. 3A is a fragmentary view partly in section like FIG. 3 but showing the embodiment wherein an outer metal strip underlies the brick assembly.

In some embodiments as shown in FIGS. 1A and 3A each flexible element 58 may be overlaid with a strip of spring steel indicated at 60 to provide more even and wear resistant contact with the bricks. Further in these embodiments the outer surface of metal strip 60 may have bonded thereto a series of pads 60' of rubber or the like for contact with the bricks. Pads 60' act as compensators for irregularities in the bricks.

In the embodiment the metal strip 60 may be a laminate or metal skin bonded along the outer surface of solid element 58.

As shown in FIG. 1 the arcuate members 44 and 45 extend from a space 50 above the top frame member 37, and a T-fitting 61 connected by a conduit 62 through a control valve 63 to a source of air pressure 64 provides for simultaneous expansion of both expansible members 57 when the valve is opened. When the valve is closed conduit 62 exhausts to atmosphere and the members 57 collapse to brick loading position. At their ends opposite the T-fitting each expansible member 57 extends beyond the arcuate member and is closed air tight as by plugs 65.

In operation the rig frame 29, after being mounted on the tracks 28, may be adjusted laterally to bring the arcuate members 44 and 45 to the desired shape and proximity to shell 26, and variation of the curvature of the arcuate members may be made to suit the contour of the shell. Adjustment of the frame itself to suit different diameter kilns may be accomplished at 37 and 41. This enables the rig to be used in a wide number of different diameter kilns. Since the arcuate members 44 and 45 are wholly supported on the adjustable jacks 46 and 47, shifting of the members 44 and 45 toward and from the shell is facilitated, and equally importantly since members 54 are longitudinally flexible relative adjustment of the two jacks attached to the same member 44 or 45 may change the curvature of that member to suit that of the shell.

The rows of bricks 23 are built up as columns on the arcuate members 44 and 45 from location 24 to the region above space 50, and the members 57 are then expanded to simultaneously bring the opposite columns into firm contact with the interior of shell 22, with equal pressure in all of the bricks. There will be a space between the adjacent upper ends of the columns equal to the size of one brick and that key brick is inserted in place between. Then the pressure in member 57 is reduced, the bricks remaining in place on the shell, and the rig may be moved on tracks 28 to build the next row along the kiln.

It is preferable that the brick column be directly contacted by the continuous, smooth, flexible outer surface of solid element 58. This eliminates the possibility of bricks encountering depressions or irregularities, or joints between parts of an articulated member such as disclosed in the Byfield patent. Moreover it is often necessary to drive shins to tighten the brick due to irregularities in the shell surface, and by providing a smooth continuous brick contact outer surface such as surface 59 that is no danger of shins damaging the inflatable element 57. Essentially the same advantages accrue when the solid member is overlaid by a metal skin or strip as above noted.

Figure 6:
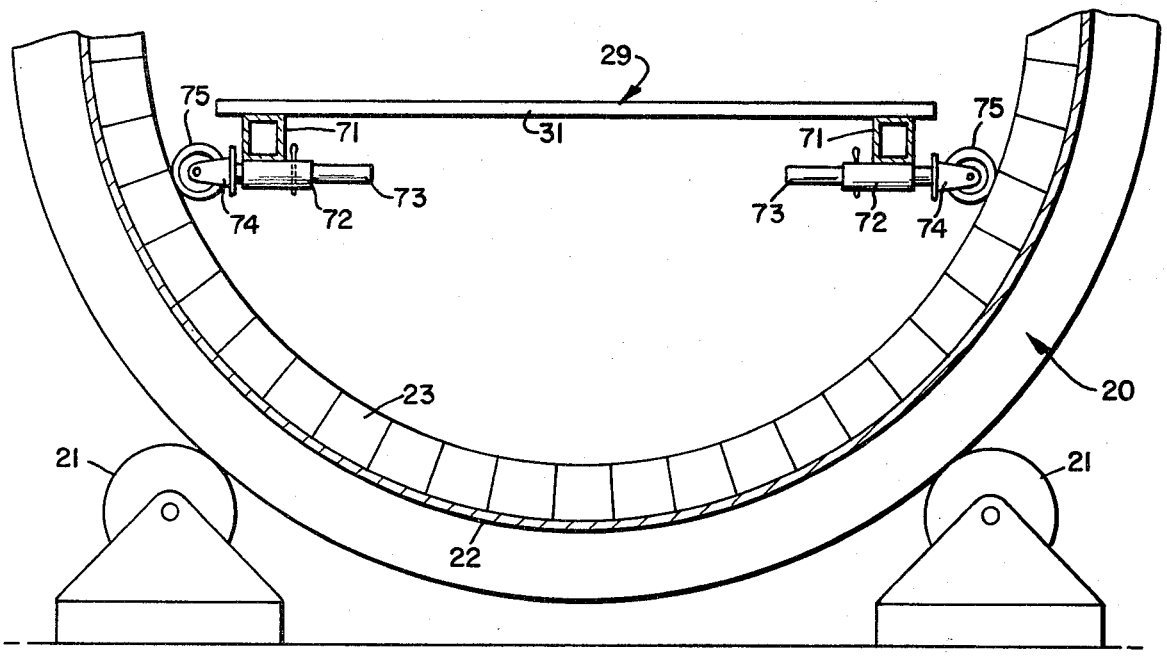
FIG. 6 is a partial end view partly in section showing an embodiment wherein the rig frame is supported by the lower lining of brick.

In some embodiments the underside of the rig frame may be provided with means whereby it may turn about the kiln axis, as where it is desirable to rotate the kiln during part of the lining operation. Here as shown in FIG. 6 frame 29 has parallel beams 71 fixed to the bottom of frame member 29, and each beam carries a bracket 72 in which is disposed the post 73 of a wheel mount 74 of a freely rotatable brick engaging wheel 75. Posts 73 can be adjusted to contact the wheels with different kiln diameters. Thus should the kiln be turned about its axis as on the rollers 21 in FIG. 1, the frame 29 may be compensatively oppositely turned to remain properly oriented.

Figure 7:
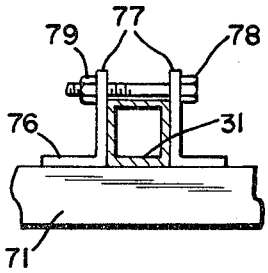
FIGS. 7 and 8 are fragmentary views in section showing the intermediate clamp mounting for the lower member of the rig frame.
Figure 8:
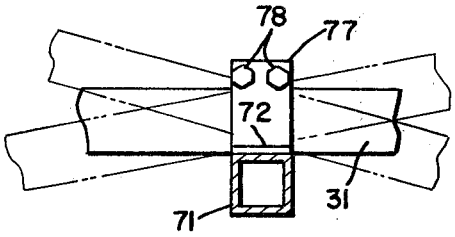

FIGS. 7 and 8 show tiltable mounting of the rig frame in FIG. 6. Here each beam 71 carries two sets of L-shaped clamp brackets 76 fixed at their lower arms to the beam, with the upstanding arms 77 of each bracket spaced substantially the width of the frame lower frame member. Bolts 78 extend through arms 77 a short distance above and when the nuts 79 are loose the member may slide and tilt in the brackets. The nuts 79 are tightened when the desired attitude of the frame 29 is attained. FIG. 8 shows that the frame member 31 may assume a slightly canted adjusted position as permitted by the space below the bolts.

Figure 9:
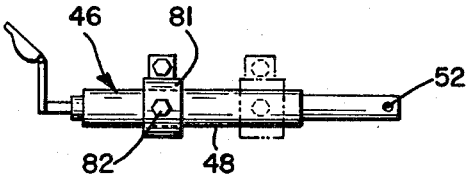
FIG. 9 is a fragmentary view partly in section showing a variation in jack structure.

FIG. 9 shows a frame jack 46 with an adjustable mounting collar 81 which is essentially a split tubular clamp adapted to be fixed along the jack barrel in any desired location, whereby to effectively lengthen or shorten the jack overall to contact with flange 49 of FIG. 3 suit it to the particular frame adjustment and shell diameter. A set screw 82 may aid in anchoring the collar.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for lining with brick a kiln, tunnel or like arcuate surface comprising a frame adapted to be mounted within the surface to be lined, means for mounting on said frame at least one arcuate member adapted to extend in spaced relation to the surface to be lined and adapted to locate and support a column of brick substantially in the space between said member and said surface, said arcuate member being supported on the frame and comprising a continuous base member which is longitudinally deformable so that it may be adjusted to fit the contour of the surface to be lined, an elongated tubular expansible member extending in overlying relation along said base, and a relatively solid flexible member loosely overlying said expansible member, said flexible member being in the form of a length of solid rubber or rubber-like material, whereby said apparatus is adaptable for any of various irregularities of the brick or the surface to be lined.

2. Apparatus for lining with brick a kiln, tunnel or like arcuate surface comprising a frame adapted to be mounted within the surface to be lined, means for mounting on said frame at least one arcuate member adapted to extend in spaced relation to the surface to be lined and adapted to locate and support a column, of brick substantially in the space between said member and said surface, said arcuate member comprising a continuous longitudinally deformable metal base strip supported on said frame, said base strip having flexible side bands bonded thereto to define a continuous trough that opens outwardly, an elongated tubular expansible member extending in overlying relation along said base strip so as to lie along the bottom of the trough, and a relatively solid flexible member loosely overlying said expansible member.

3. Apparatus for lining with brick a kiln, tunnel or like arcuate surface comprising a frame adapted to be mounted within the surface to be lined, means for mounting on said frame at least one arcuate member adapted to extend in spaced relation to the surface to be lined and adapted to locate and support a column of brick substantially in the space between said member and said surface, said arcuate member being supported on the frame and comprising a continuous base member which is longitudinally deformable so that it may be adjusted to fit the contour of the surface to be lined, an elongated tubular expansible member extending in overlying relation along said base, and a relatively solid flexible member loosely overlying said expansible member, said flexible member being overlaid with a strip of metal which provides a surface for contacting the bricks, and with compensator pads secured on the brick contacting surface of said metal strip.

4. The apparatus defined in claim 1, wherein there are two of said arcuate members on said frame, one at each side of the kiln, and said arcuate members are independently mounted on said frame.

5. The apparatus defined in claim 4, wherein a common source of air pressure is connected through a valve and a fitting to adjacent ends of the tubular expansible members in the respective arcuate members.

6. Apparatus as defined in claim 2 or 3, said flexible member comprising a length of solid rubber or rubber-like material.

7. The apparatus defined in claim 2, wherein said side bands are non-metallic stretchable elements bonded to and upstanding from the metal base.

8. The apparatus defined in claim 1 or 2 wherein said solid flexible member has an outer continuous surface for direct contact with the bricks.

9. The apparatus defined in claim 1 or 2 wherein said flexible member is overlaid with a strip of metal providing a surface for contacting the bricks.

10. The apparatus defined in claim 1, 2 or 3 wherein said arcuate member is mounted on said frame by at least two relatively adjustable jacks, adjustment of said jacks determining the shape and location of the brick column contacting surface of said arcuate member.

11. The apparatus defined in claim 1, 2 or 3 wherein means is provided for varying the operative width of the frame across the kiln.

12. The apparatus defined in claim 1, 2 or 3 wherein said frame is mounted for movement along platform tracks that extend longitudinally of the kiln, and means is provided for varying the attitude of the frame relative to the platform.

* * * * *

UNITED STATES PATENT AND TRADEMARK OFFICE

CERTIFICATE OF CORRECTION

PATENT NO. : 4,363,202

DATED : December 14, 1982

INVENTOR(S) : Eugene B. Kenyon

It is certified that error appears in the above—identified patent and that said Letters Patent is hereby corrected as shown below:

Column 6, line 35, change "Claim 1" to --Claims 1, 2, or 3--.

Signed and Sealed this

*Eighth* Day of *March 1983*

[SEAL]

*Attest:*

GERALD J. MOSSINGHOFF

*Attesting Officer*

*Commissioner of Patents and Trademarks*